US005386910A

United States Patent [19]

Liss

[11] Patent Number: 5,386,910

[45] Date of Patent: Feb. 7, 1995

[54] CONTAINER FOR PLASTIC BAGS

[76] Inventor: Olle G. Liss, Sturegatan 9, S-753 14 Uppsala, Sweden

[21] Appl. No.: 30,282

[22] PCT Filed: Sep. 26, 1991

[86] PCT No.: PCT/SE91/00647

§ 371 Date: Mar. 26, 1993

§ 102(e) Date: Mar. 26, 1993

[87] PCT Pub. No.: WO92/06020

PCT Pub. Date: Apr. 16, 1992

[30] Foreign Application Priority Data

Sep. 27, 1990 [SE] Sweden ..... 9003064

[51] Int. Cl.[6] ..... B65D 85/16; B65D 83/08; A47G 29/00

[52] U.S. Cl. ..... 206/554; 220/676; 220/908; 221/309; 229/927

[58] Field of Search ..... 206/554, 494; 221/303, 221/307, 309; 232/1 C, 1 E; 229/927; 220/676, 908, 910

[56] References Cited

U.S. PATENT DOCUMENTS

| | | | |
|---|---|---|---|
| 4,042,156 | 8/1977 | Knight | 221/309 |
| 4,199,078 | 4/1980 | Ramirez | 221/309 |
| 4,580,695 | 4/1986 | Lum | 206/494 |
| 4,735,313 | 4/1988 | Schoenberg | 221/309 |
| 4,762,233 | 8/1988 | Sears et al. | 229/927 |
| 4,828,107 | 5/1989 | Spencer | 206/366 |
| 4,842,138 | 6/1989 | Sandel et al. | 206/366 |
| 5,147,119 | 9/1992 | Harris | 221/303 |

*Primary Examiner*—David T. Fidei
*Attorney, Agent, or Firm*—Jeffrey Slusher

[57] ABSTRACT

A container for plastic bags has a mainly flat rear mounting portion for attachment to a supporting surface, two opposing, partially curved side walls, and a bottom portion. The top of the container is open. A slit extends vertically between the side walls, which extend toward each other opposite the mounting portion. A user can insert bags into the container through the open top and press them down to the bottom of the container. The user's wrist thereby fits in the slit between the side walls. Bags can be removed from the container by pulling them out through the slit.

1 Claim, 4 Drawing Sheets

CONTAINER FOR PLASTIC BAGS

BACKGROUND OF THE INVENTION

1. Field of the Invention

This invention relates to a container for plastic bags, especially of the carrier bag kind. The object of the container is to provide for a simple and rational way of collecting plastic bags in connection with re-use of the bags.

2. Description of the Related Art

Plastic bags, especially of the carrier bag kind, are re-used to a considerable extent for several reasons, e.g. economical and environmental reasons. The storage of these bags, which are to be re-used, is a common known problem, since the alter- natives that are offered to-day either require large space or imply a complicated way of folding which is time consuming.

Known containing means, of the kind requiring much space in its simplest form consists of a carrier bag. The form of the carrier bag and its structure makes it impossible to store plastic bags in a non-space consuming manner, at least if it should be combined with a rational and simple way of stuffing away. Accordingly, such a container requires large space, which of course is not desirable. Furthermore, it is not possible to perform a selective picking out of plastic bags in a rational and simple manner. Moreover, it is difficult to mount such a container in a good way, as a result many people just have such a carrier bag filled with other plastic bags lying around in a cupboard, which also leads to other disadvantages not described above and which of course is far away from an optimum solution. There are to-day on the market not known any alternative containers which are suited for a not space consuming collection of plastic bags. If one desires to have a not space consuming collection of such bags, the bags therefore have to be folded in a special manner, e.g. to be stored in a drawer. This latter method implies the disadvantage that it is very time consuming, and also that a selective picking out cannot be performed without problems. Furthermore, it is not easy in a rational manner to store the above drawer in a practical vicinity to the place where garbage bags are kept, which is the most frequent way of using such plastic bags.

The object of this invention is to provide a device which eliminates the above mentioned disadvantages.

A further object of the invention is to provide for such a device which is relatively cheap to produce, has relatively low weight, is easy to attach on an optimum place, etc.

SUMMARY OF THE INVENTION

The invention provides a container for plastic bags that has a mainly flat rear mounting portion for attachment to a supporting surface, two opposing, partially curved side walls, and a bottom portion. The top of the container is open and the opening extends from the top to the bottom portion between the side walls. A slit extends vertically between the side walls, which extend toward each other opposite the mounting portion. A user can insert bags into the container through the open top and press them down to the bottom of the container. The slit is wide enough that a user's wrist fits between the side walls so that bags can be removed from the container by pulling them out through the slit.

BRIEF DESCRIPTION OF THE DRAWINGS

The invention will now be described in more detail with reference to the annexed figures in which.

DETAILED DESCRIPTION

Figure 1:
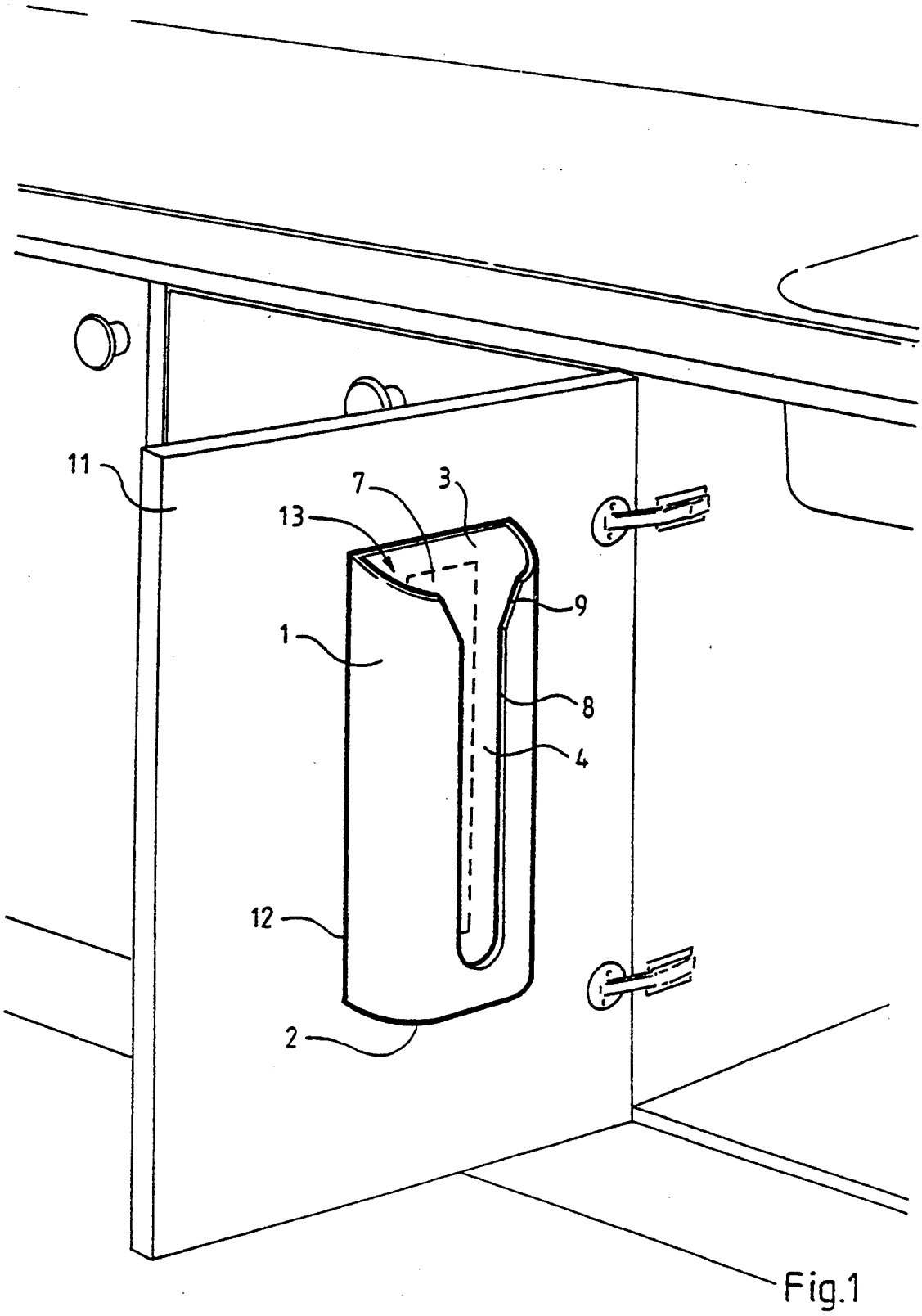
FIG. 1 shows a device according to the invention in a perspective view, attached to a door.

FIG. 1 shows a container according to the invention which is attached on the inside of a cupboard door 11. The container consists of a bottom 2, an opening 13 and an envelope 1, 3 having a front with curved inner and outer surfaces. The rear wall 3 of the envelope is in contrast thereto arranged with a flat surface 12, on which double-sided adhesive tape 7 is arranged for attachment of the container to the cupboard door 11. As a supplement or instead of using the adhesive tape 7, there are also protruding means 6 with holes (FIG. 2) intended for attachments by means of screws. Further, the container has a centrally positioned slit 4 out of which parts of the stuffed away plastic bags 10 protrude (see FIG. 2), preferably the handles of carrier bags. The major part of the edges 8 of the slit run parallelly and are joined below by means of a curved portion. In the upper part of the slit 4, however, the edges are convergent 9, which results in an increasing width in relation to the lower part. Furthermore, the container is made slightly conically shaped, so that several containers can be piled within each other, during transport and storage.

Figure 2:
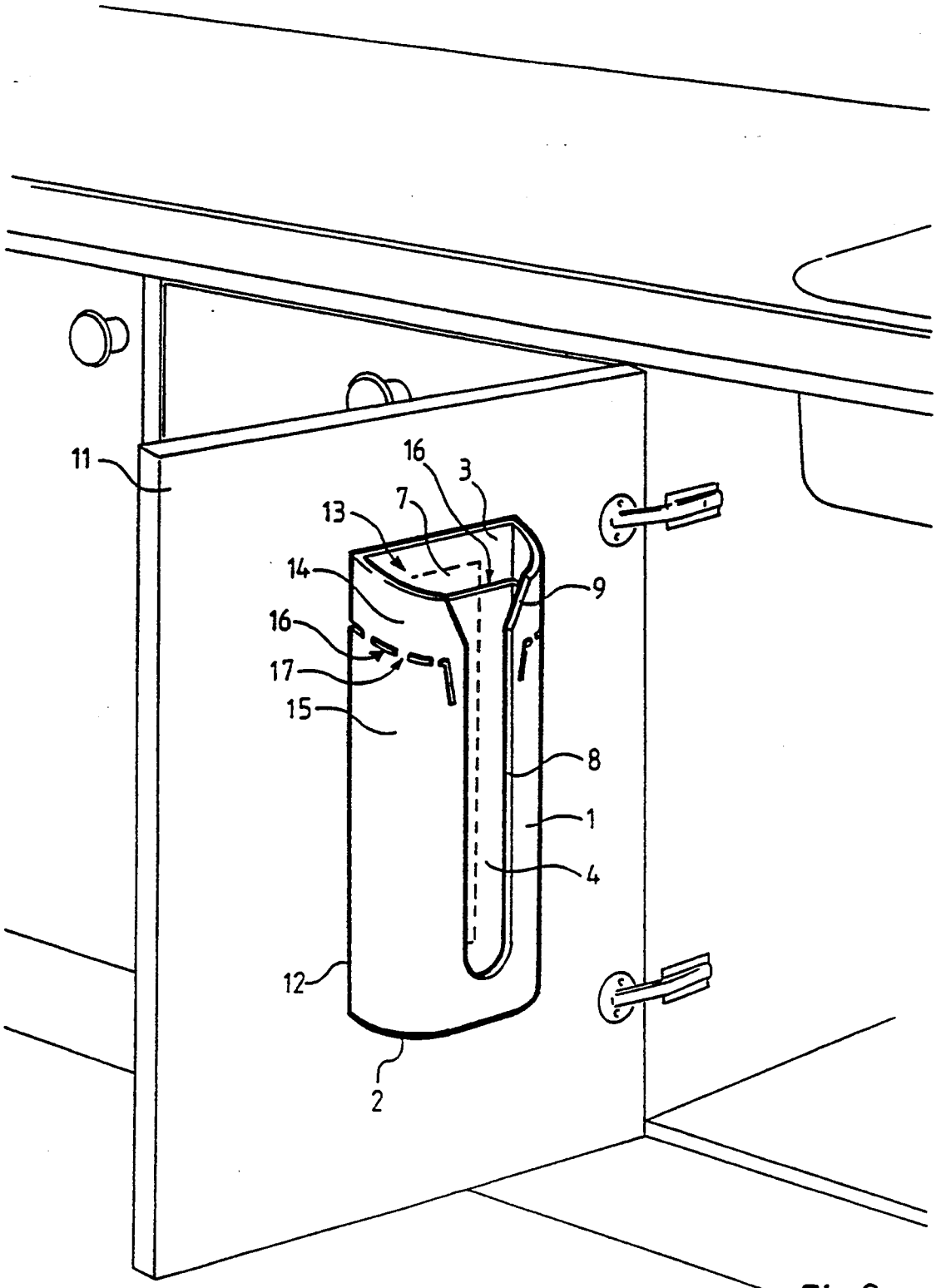
FIG. 2 shows a preferred device according to the invention in perspective, also attached to a door.

In FIG. 2 there is shown a preferred embodiment of a container according to the invention. The figure shows that this embodiment also comprises a perforation 16, 17, preferably by means of longish openings 16 and shorter bridges 17, which divides the container in an upper portion 14 and an under portion 15. By dividing the perforations in an appropriate manner, e.g. by cutting of the bridges 17, the length of the container can be adapted to the existing need, whereby, in such a case, after dividing only the lower part 15 is positioned on the desired place.

Figure 3:
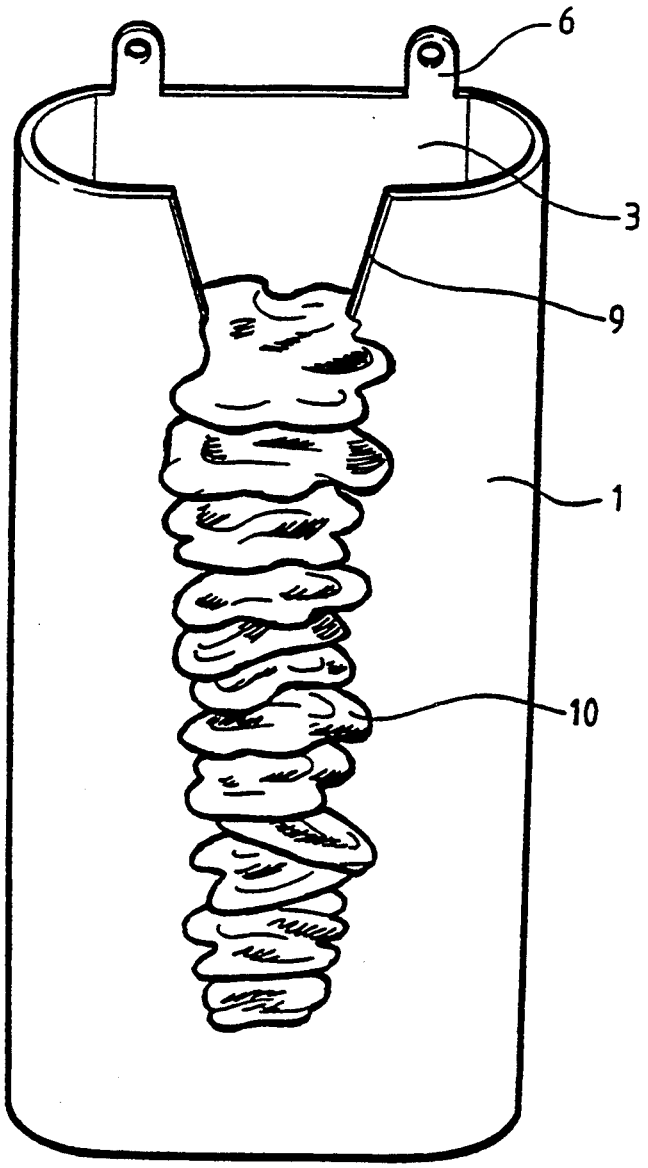
FIG. 3 shows a container according to the invention seen from the front and obliquely from above.
Figure 4:
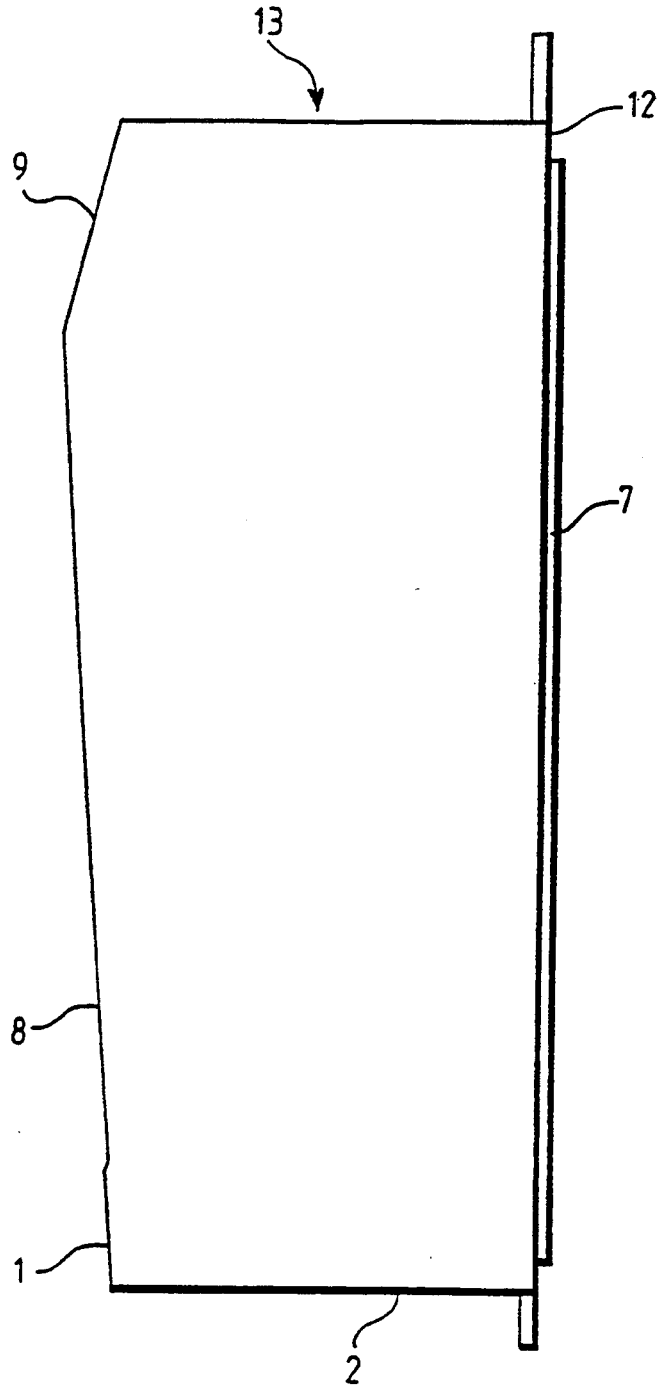
FIG. 4 shows a container according to the invention seen from the side.

FIG. 3 shows a container according to the invention when it is filled with plastic bags 10. A chosen part of the bag, preferably the handle of the carrier bag, protrudes out of the slit 4. FIG. 4 shows the embodiment which is described in FIG. 1 and 3, of a container in accordance with the invention, seen from the side.

The size of the cross sectional area of the container is adapted to the size of a hand, with appropriate consideration to the largest likely size of a hand. The reason why is that one, when stuffing a bag into it, with the hand must be able to reach down to the top of the pile of stuffed plastics bag, in order to be able to position a new plastic bag on top of the pile. Accordingly, the cross sectional area has to be large enough to allow at least most humans to find room for their hand therein. On the contrary the cross sectional area may not be too large since this would (at least in certain cases) make it impossible to fix the plastic bag in a rational manner when stuffing it in. For an effective fixing of the carrier bag in the container according to the invention it is preferred that one could be allowed to press with the hand in vicinity of the inner edge areas of the container. Accordingly, an optimum size of the container means that a person with very large hands could carry out the above mentioned with the fingers being positioned inside the palm, whereas a person with very small hands can carry out the same operation with extended fingers. This implies that the optimum cross sectional size is approximately 14 cm wide. Furthermore, the size of the cross sectional area in combination with its form is important in order to obtain the desired fixing of the plastic bag therein in a compressed condition.

Of the above another important feature of the slit is made evident, namely the function of providing for space for the wrist, which means that the hand can be moved downwardly in an optimum manner into the container when stuffing in a carrier bag. Therefore, (in accordance with the above) the slit needs to have a width so that most persons' wrists freely can be moved therein. This implies an approximate optimum width of about 5 cm. The slit 4 does not need to extend all the way along the container but can preferably be terminated somewhat above the bottom 2, which provides for increased stability but still provides for sufficient ability to reach.

An already mentioned function of the slit 4, is to provide for space for a part of the plastic bag to protrude, e.g. the handle, so that a selective picking out of the plastic bags can be performed irrespectively of the positioning within the pile.

When using the container one preferably proceeds in a following manner. When stuffing a plastic bag into the container one grips with one hand over mainly the whole plastic bag and uses the other hand, by means of the fingers, to grip a smaller part of the plastic bag, e.g. the handles of a carrier bag. Thereafter one presses the plastic bag into the container by moving the hand downwards which grips over the bag into the container opening and moves along down to the container by moving the arm in the slit 4 till one reaches the top of the existing pile of plastic bags 10, where one fixes the plastic bags by means of the hand/fingers in its compressed condition, whereby a fixation is obtained due to the inner elasticity of the bag which exerts a certain force against the inner side surfaces of the container, which, in combination with a certain frictional resistance, makes it possible to fix the plastic bag 10 in the said manner.

When a bag 10 is to be taken out, this can be made in a selective manner thanks to the slit 4. Accordingly, one grabs the protruding part belonging to the bag one decides to have and pulls straight out, in a transverse direction. Thanks to the curved outer wall parts and appropriately rounded edges 8 this can be made without any damages to the bag. Of course, it is also possible to take the upper bag out first by pulling it out of the container opening. As has already been mentioned attachment by means of a doublesided adhesive tape 7 is most preferred. The reason is that most of the plastic carrier bags are re-used for collecting garbage. The vessel for containing garbage is normally positioned within a bench cupboard, very often on the inside of one of its doors. In order to have the plastic bags in a practical vicinity, these are very often stored in the very same bench cupboard. The doors of such cupboards, however, are often of relatively poor quality, which implies that attachment by means of screws is not always trustworthy. By means of doublesided adhesive tape 7 which is properly attached this problem is solved. Furthermore, attachment by means of doublesided adhesive tape is very easy to carry out. In order to eliminate the risk for improper attachment due to uneven surfaces there is in a preferred manner a flexible intermediate layer between the two adhesive surfaces. In a preferred embodiment, however, the device is also provided with attachment means 6 for screws.

The container is preferably produced by means of moulding, e.g. in polyethylene or acrylic plastic. An advantage with acrylic plastic is that the container can be made transparent whereby it is easier to find and choose the desired plastic bag. In a preferred embodiment the device has the following measures: height 45 cm, rear wall width 12 cm, slit size 5 cm, radius of the curvature of the front edge 7,5 cm and a goods' thickness of 1,3 mm.

The invention is not limited by the above shown but can be varied within the scope of the following claims, accordingly it is for example not necessary to have a slit 4, it functions also without this, even if the possibility of selecting then is lost and at the same time the maximum length of the container is limited of natural reasons. Furthermore, if there is a slit, only a preferred embodiment has a larger width of the slit in the upper part. Moreover, the slit can run all the way down to the bottom 4 of the container. The skilled man also realizes that the invention can be varied within wide frames departing from the measures defined above. Moreover, it is of course possible to arrange the container with more than one perforation 16, 17.

I claim:

1. A container for storing bags for re-use comprising:

a substantially flat rear mounting portion that extends in a lengthwise direction and is provided for attachment to a supporting surface;

a pair of opposing side walls that are joined with the mounting portion, extend in the lengthwise direction, and have inward extending, opposing inner edges opposite the mounting portion;

a bottom portion joined to the mounting portion and to each of the side walls;

said side walls defining a receiving and holding opening that extends from a top of the container to the bottom portion and between the side walls;

a slit that extends lengthwise between the inner edges of the side walls and into the receiving and holding opening;

said side walls and said receiving and holding opening enabling a user to insert the bags from above into the receiving and holding opening and to store the bags for re-use between the side walls;

said side walls and said lengthwise extending slit allowing a hand of a user to reach between the side walls through and over the entire lengthwise extent of the slit and to remove arbitrary ones of the bags from the container through the slit;

said container being divided into at least an upper and a lower portion by a perforation that extends around the side walls and mounting portion, said upper portion being removable from the lower portion along the perforation.

* * * * *